US005142758A

United States Patent [19]

Delhaes

[11] Patent Number: 5,142,758

[45] Date of Patent: Sep. 1, 1992

[54] TRANSPORT ROLLER FOR PAPER SHEETS

[76] Inventor: Johannes C. Delhaes, Esschenderweg 93, NL Voerendaal, Fed. Rep. of Germany

[21] Appl. No.: 686,158

[22] Filed: Apr. 17, 1991

[30] Foreign Application Priority Data

Apr. 21, 1990 [DE] Fed. Rep. of Germany ..... 4012748

[51] Int. Cl.[5] ..... B60B 9/00

[52] U.S. Cl. ..... 29/117; 29/130; 29/132

[58] Field of Search ..... 29/117, 124, 125, 130, 29/132

[56] References Cited

U.S. PATENT DOCUMENTS 3,827,120 8/1974 Mayer ..... 29/130

4,910,845 3/1990 Delhaes ..... 29/125

FOREIGN PATENT DOCUMENTS 940798 11/1963 United Kingdom ..... 29/129

*Primary Examiner*—P. W. Echols

*Assistant Examiner*—David P. Bryant

*Attorney, Agent, or Firm*—Mark T. Basseches

[57] ABSTRACT

For the transport of widths or sheets of paper, a roller is disclosed which comprises a bushing (1), which is surrounded by an elastic cylindrical casing. The bushing has a coaxial bore into which a shaft (3) is pressed. The bore of the bushing (1), which limits the clearance is provided with radially inwardly extending protrusions (2), which are evenly angularly spaced about the bore and which extend in the axial direction. When pressing the shaft (3) into the bushing (1) of the roller body, the protrusions (2) are forced to move radially outwards and effect a rotationally secure connection of the roller body to the shaft (3). Any expansion of the bushing will be even and while possibly enlarging the casing will not interfere with concentricity.

4 Claims, 5 Drawing Sheets

TRANSPORT ROLLER FOR PAPER SHEETS

BACKGROUND & FIELD OF THE INVENTION

This invention relates to a roller for the transport of widths or sheets of paper with a roller body comprising an elastic, externally cylindrical casing which surrounds a bushing. The bushing is provided with a bore having inwardly facing protrusions defining angularly spaced axially directed clearances adjacent the bore. The bushing may be mounted on a shaft by forcing the shaft into the bore. The bushing can be arranged rotationally secure on the shaft, as the shaft diameter is larger than the free diameter of the clearance in the bushing or roller body.

THE PRIOR ART

From the DE-PA 31 40 546 is known a roller consisting of a non-elastic, tubular casing with at least one elastic bushing inserted therein, which bushing is encased by an inner and an outer sleeve of metal and which concentrically holds the casing on a shaft. The inner sleeve then comprises a clamping sleeve, which is seated on the shaft with radially inwardly oriented clamping force, and the outer sleeve comprises a journal bush, which is seated in the casing with radially outwardly oriented clamping force.

This known roller permits a stable connection to the shaft by means of commercially available fixing means, whereby it is not required to adhere to close tolerances between the shaft diameter and the inside diameter of the rigid casing.

The known roller requires relatively elaborate mounting due to the use of two sleeves, i.e. an inner sleeve and an outer sleeve. If the roller is to be provided with a casing of rubber or rubber-like elastically deformable material instead of a rigid casing, then a rotationally secure arrangement of the roller onto the shaft by means of known fixing means is entirely out of the question. The radially outward directed clamping force of the outer sleeve, which force is required for radially securing it, would severely deform the elastic casing of the roller. This deformation cannot be compensated by subsequent cylindrical processing of the casing as long as the sleeve is clamped, in which respect the clamping force is particularly intensive in the areas of reduced sleeve thickness.

From the DE-PS 37 02 251 (and U.S. Pat. No. 4,910,845) is known a roller of the initially described type, the aim of which is to provide an easily produced roller which permits a simple construction, a rotationally secure arrangement on a shaft, and which provides a sufficiently precise cylindrical shape of the casing prior to its mounting onto the shaft, which shape is maintained even after clamping the roller to the shaft. This roller is provided with an elastic, externally cylindrical roller body comprising a bore coaxial relative to its cylinder casing. Into this bore is pressed a shaft, the diameter of which is larger than that of the bore, thus radially expanding the bore. The elastic roller body comprises two interconnected cylinder sections. Of these, the inner cylinder has an outside diameter corresponding to the inside diameter of a rigid bushing which is radially arranged between the cylinder sections, and the outer cylinder section has an inside diameter corresponding to the outside diameter of the bushing. The connection of the two cylinder sections is by means of webs, which fill radial holes in the bushing and which are of the same elastic material as the two cylinder sections.

The known roller offers considerable advantages which cannot be matched in their entirety by any of the other known rollers, due to the integration of the fixed bushing into the elastic body shape between the outside diameter of the one and the inside diameter of the other cylinder section and the direct inter-connection of the cylinder sections through the bushing.

However, rollers of this type of three-part roller-body assembly must be of a certain minimum outside diameter of the roller body so that the wall thickness of both cylinder sections does not fall below a minimum thickness. A certain minimum wall thickness of the cylinder section which is arranged inside the bushing and comprises the shaft engaging bore is required in order to allow a sufficiently high clamping force against the shaft. A certain minimum wall thickness of the cylinder section, which is arranged outside and forms the casing of the roller body, is required in order to ensure the elasticity demanded of the roller for the transport of widths or sheets of paper.

SUMMARY OF THE INVENTION

It is an object of the present invention to provide a roller for paper feed which can be readily rotationally secured on a shaft whilst maintaining its easy way of production, and in particular permitting a high degree of elasticity of the roller casing even if the given outside diameter of the roller is relatively small.

The object is achieved by providing a bushing of softer material than the shaft on which it is to be mounted yet harder then the elastomeric casing surrounding the bushing, the bushing including an axial bore having radially inwardly projecting axially extending ribs or projections, the shaft diameter being smaller than the bore but larger than the clearance space between the radial innermost edges of the projections.

The bushing of the present invention adopts the functions of the three part roller described above using only two sections and thus permits the wall thickness of the elastic casing to be larger than would be possible with the three part roller for a given size outside diameter.

By even angular spacing of the protrusions, which extend radially inwardly about the inner circumference of the bushing, the elastic deforming of the bushing when pressing the bushing onto the shaft can be substantially limited to the deforming of these protrusions, avoiding an asymmetric deformation of the casing, even if the deforming affects an expansion of the other sections of the bushing. Consequently, the roller-body blank can be dimensioned by taking into account an anticipated rotation-symmetrical expansion of the bushing of defined elasticity, when the same is mounted on a shaft. The outside diameter of the elastic cylindrical casing can be given a diameter which is chosen to be smaller than the desired finished diameter by the expected amount of expansion of the bushing when pushed onto the shaft.

In an embodiment of the invention, pushing the roller body or bushing onto the shaft whilst avoiding canting can be simplified by providing that the height of the protrusions continually reduces at a distance from the end faces of the bushing, and the protrusions merge with the bushing bore at an acute angle. As the maximum inside diameter of the bushing is preferred to be slightly larger than the shaft diameter, the shaft can be entered into the clearance with one end section initially without resistance, then expands same due to the protrusions which increasingly support themselves against the shaft circumference relative to the shaft diameter.

In further embodiments of the invention, the protrusions are formed by thickenings on the interior face of the bore of the bushing, or the outside of the sleeve is provided with corrugations so that protrusions on the inside of the bushing are opposed by corresponding recesses on the outside of the bushing, a construction which inherently augments the connection with the elastic casing.

The bushing is preferably made of a zinc-aluminum alloy in the form of a cast member, which results in the following specific advantages:

The bushing is not only produced economically and true to shape, but it is also of high restoring force whilst pressed onto the shaft. This brings about high torsional connection of the roller on the shaft.

During an axial displacement over the shaft for the purpose of mounting the roller, the protrusions of the bushing do not leave ridges on the shaft, as the hardness of a cast member of zinc-aluminum alloy is considerably lower than the hardness of steel shafts.

Finally, a bushing of this type can also be inserted into a form in axially pressed state, and after the application of an adhesive agent, the cylindrical casing can be vulcanized onto the bushing without particles of the casing material being deposited on the end surfaces of the bushing or even entering into the inside of the bushing. The height of the bushing can be reduced by approximately 0.05 to 0.1 mm by axial pressure, in which respect the end surfaces are covered completely, and not the slightest gap remains between them and the form bottom as well as its cover. Thus, otherwise elaborate finishing work of the produced roller body for freeing it of surplus particles of the casing material can be dispensed with.

DETAILED DESCRIPTION OF THE DRAWINGS

In all exemplary embodiments, the bushing marked 1 is provided with protrusions 2 in even angular spacing over its inside circumference at distances according to angle B, which protrusions protrude radially inwards and extend in the axial direction over a substantial part of the length of the bushing. In all instances, the rubber or like elastic casings C surrounding the bushings are shown in dotted lines.

Figure 1A:
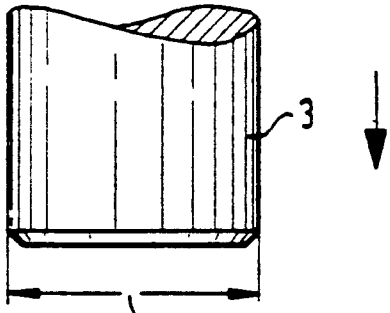
FIGS. 1*a*, 2*a* and 3*a* are top plan views of a shaft to which the roller is to be mounted.
Figure 1B:
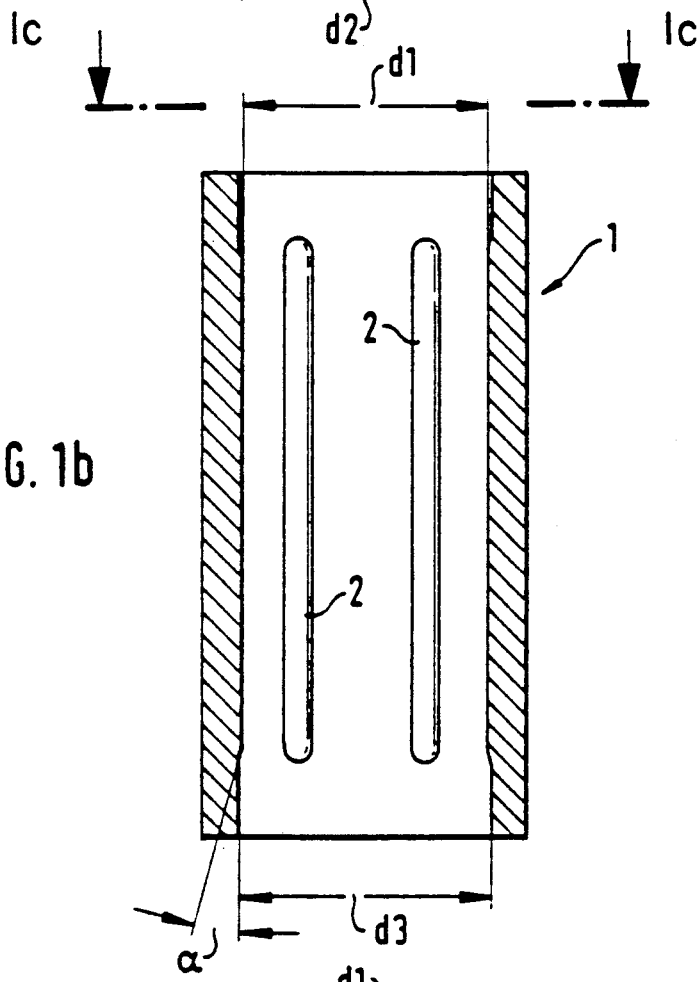
FIGS. 1*b*, 2*b* and 3*b* are longitudinal sectional views through three respective embodiments of the invention.
Figure 1C:
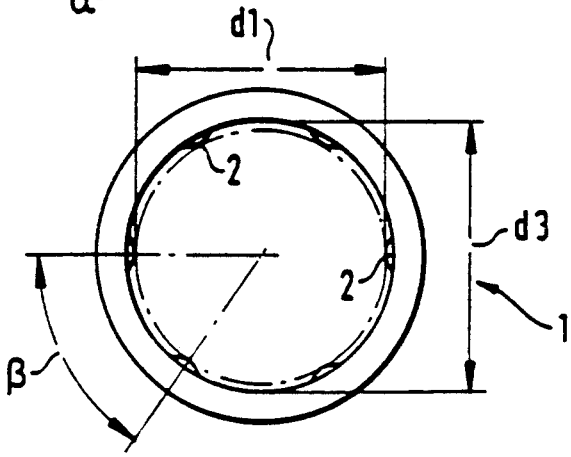
FIGS. 1*c*, 2*c* and 3*c* are transverse sections of the embodiment of FIGS. 1*b*, 2*b* and 3*b* respectively.
Figure 2A:
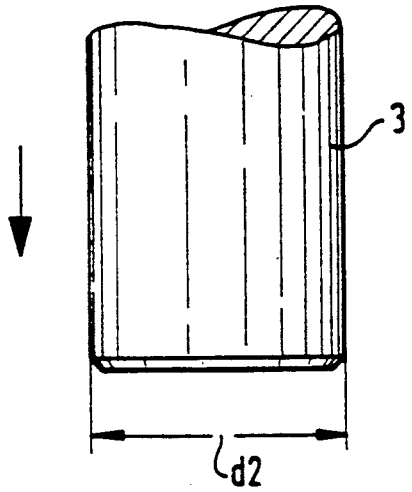
Figure 2B:
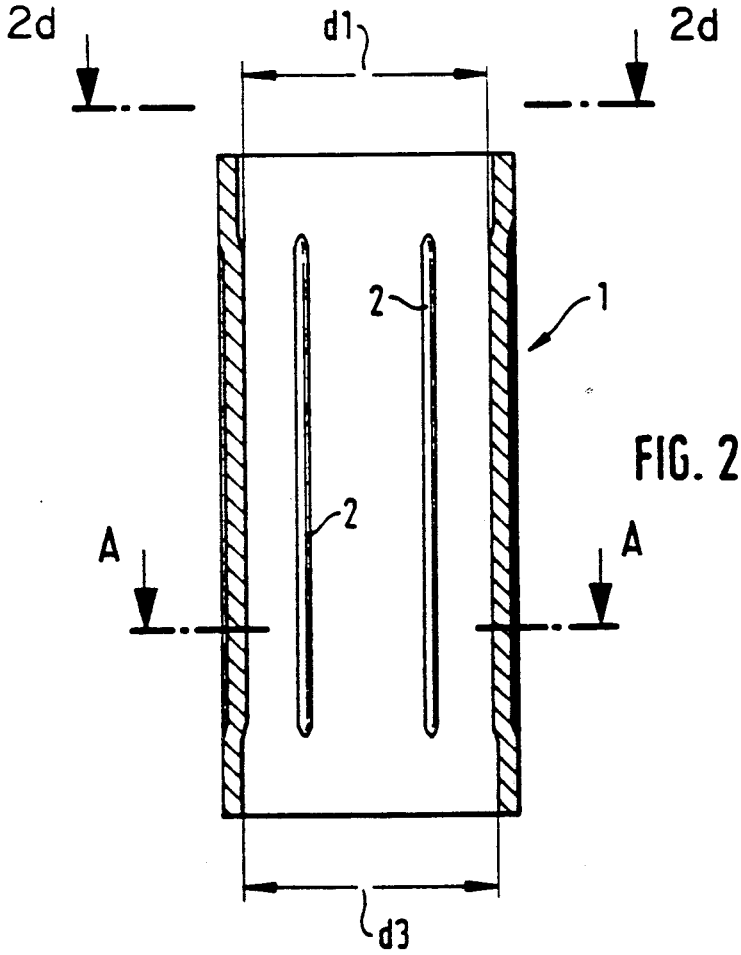
Figure 3A:
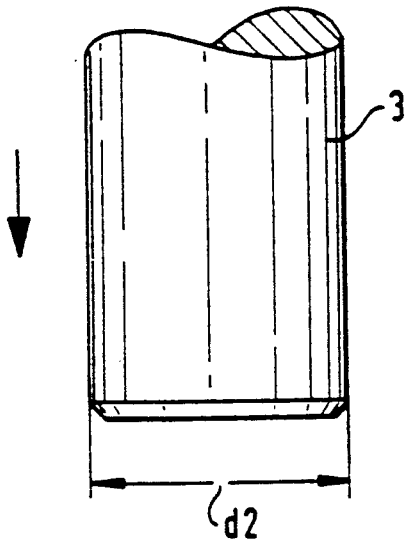
Figure 3B:
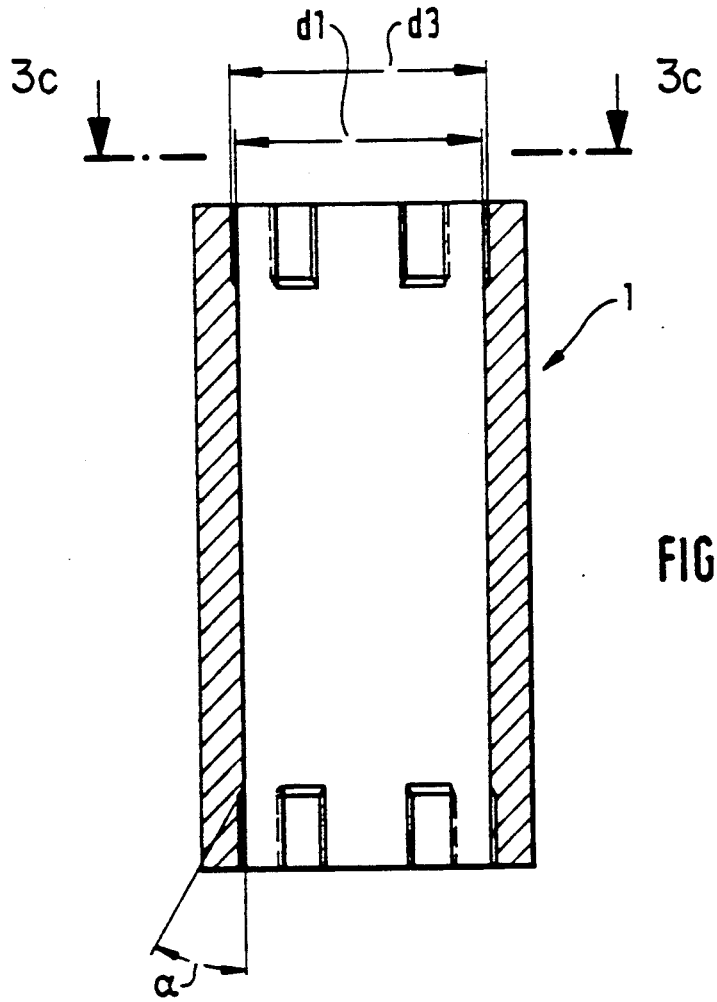
Figure 3C:
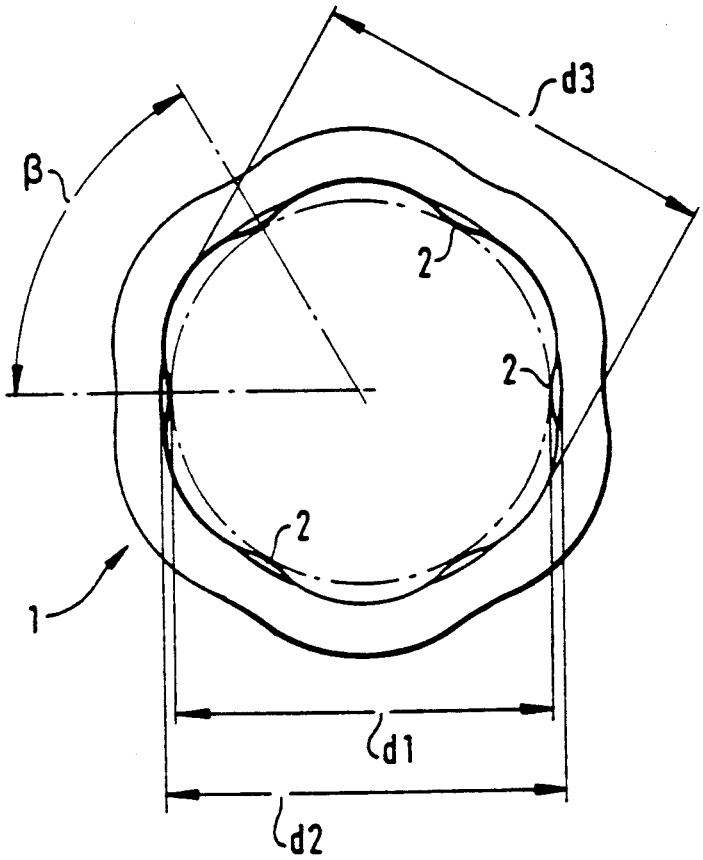
Figure 2C:
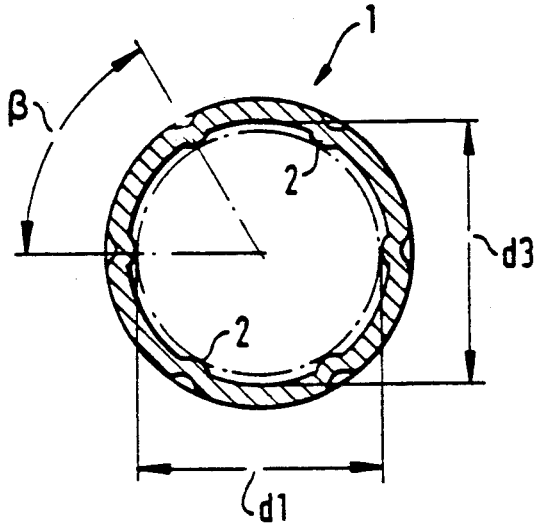
Figure 2D:
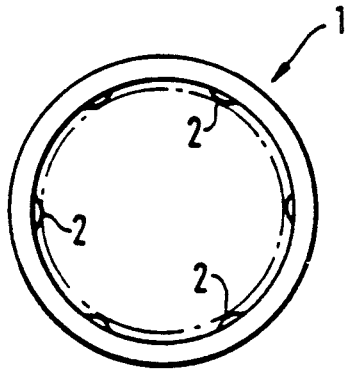
FIG. 2*d* is an end elevational view of the embodiment of FIG. 2.

Protrusions 2 can be formed by thickenings in the casing of bushing 1, as shown in FIG. 1*b* and 1*c*. However, protrusions 2 can also be formed in that the outside of bushing 1 is given a corrugated configuration recessed on the external surface opposite the protrusions 2, as shown in FIG. 2*b* and 2*c*. Furthermore, the protrusions can also be formed by an overall wavy arrangement of the casing of bushing 1, in which respect the bushing is given an inside and outside sine-shaped contour, as shown in particular in FIG. 3*c*.

The innermost cusps of protrusions 2 lie on a circle of diameter d1 which is smaller than the bore diameter d3 of bushing 1. A shaft 3 with a diameter d2 is insertable into bushing 1. As diameter d2 of shaft 3 is smaller than diameter d3 of bushing 1, but larger than diameter d1 of bushing 1, shaft 3 can only be entered without effort into the protrusion-free end regions of bushing and further push-on action requires a pressure force which is sufficient both to displace protrusions 2 of bushing 1 onto the diameter d2 of the shaft and to overcome the friction during axial displacement of the bushing.

The protrusions extend at a distance relative to the end surface of bushing 1 at an acute angle A towards diameter d3 so as to facilitate continuous initiation of expansion of bushing 1 and to avoid shearing off of protrusions 2 by shaft 3.

From the foregoing, it will be appreciated that there is disclosed in accordance with the invention a novel paper feed roller adapted to be readily press fit onto a shaft. Due to the construction of the roller it is possible to provide a maximum thickness of elastic casing for a given roller diameter.

Numerous variations in details of construction may be made without departing from the spirit of the invention by skilled workers familiarized with the instant disclosure. Accordingly the invention is to be broadly construed with the scope of the appended claims.

I claim:

1. In a transport roller adapted to be press fittedly mounted on a hardened shaft for the feeding of widths of paper and comprising an external elastic cylindrical casing mounted on a bushing, the improvement which comprises said bushing being formed of a material of lower elasticity than said casing and of softer material than said shaft, said bushing including an inner cylindrical axially directed bore of larger diameter than the outer diameter of said shaft, said bushing including axially directed regularly angularly spaced apart protrusions extending radially inwardly into said bore, the axial endmost portions of said protrusions merging with said bore at acute angles, the radial innermost extremities of said protrusions lying on a circle, the diameter of said circle being less than the diameter of said shaft, said bushing including recesses on the outer face thereof in registry with said protrusions.

2. The roller of claim 1 wherein said protrusions merge with said bore at positions inwardly spaced from the ends of said bore.

3. A roller in accordance with claim 1 wherein the inner surface of said bushing is of a sine-shaped contour, the radial innermost portions of said projections defining the apices of said sine-shaped contour.

4. A roller in accordance with claim 1 wherein said bushing is comprised of a cast zinc-aluminum alloy.

* * * * *